US005971809A

United States Patent [19]

Ho

[11] Patent Number: 5,971,809

[45] Date of Patent: Oct. 26, 1999

[54] ELECTRICAL CONNECTOR ASSEMBLY

[75] Inventor: Yu-Ming Ho, Pan-Chiao, Taiwan

[73] Assignee: Hon Hai Precision Ind. Co., Ltd., Taipei Hsien, Taiwan

[21] Appl. No.: 08/903,122

[22] Filed: Jul. 30, 1997

[51] Int. Cl.[6] ..... H01R 17/00

[52] U.S. Cl. ..... 439/660; 439/74

[58] Field of Search ..... 439/74, 660

[56] References Cited

U.S. PATENT DOCUMENTS

| | | | |
|---|---|---|---|
| 4,026,625 | 5/1977 | Roiko et al. | 439/660 |
| 5,098,311 | 3/1992 | Roath et al. | 439/74 |
| 5,181,855 | 1/1993 | Mosquera et al. | 439/74 |
| 5,310,357 | 5/1994 | Olson | 439/660 |
| 5,599,192 | 2/1997 | Olson | 439/660 |

*Primary Examiner*—Steven L. Stephan
*Assistant Examiner*—J. F. Duverne

[57] ABSTRACT

A board-to-board connector assembly consists of a plug and receptacle connector. The receptacle connector has a first dielectric housing having a front wall defining a recess with a flared inlet and a number of first contacts. Each first contact has a contact portion having an arced configuration, a free end resting against a front end of the front wall by a preload to make the contact portion have a tendency moving toward the recess, and a terminal portion extending through a locating block integrally formed at a rear side of the housing. The plug connector has a second dielectric housing defining a projection and a number of second contacts. Each second contact has a contact portion, a free end, a protrusion between the contact portion and the free end and a terminal portion extending through a locating block integrally formed at a rear side of the second housing. When the receptacle and plug connectors are connected, and a vibration is exerted thereto to cause a separation thereof, the protrusions will be blocked by the contact portions of the first contacts to prevent such separation. Furthermore, the contact force between the engaging contacts of the two connected connectors is a sum of the preload and a pushing force of the second contacts acting on the contact portions of the first contacts.

20 Claims, 9 Drawing Sheets

ELECTRICAL CONNECTOR ASSEMBLY

BACKGROUND OF THE INVENTION

1. Field of the Invention

The invention relates to an electrical connector assembly, particularly to a board-to-board connector assembly which includes a plug connector used to be soldered to a first printed circuit board (PCB) and a receptacle connector used to be soldered to a second PCB. The first and second PCBs are electrically interconnected when the plug connector is inserted into the receptacle connector.

2. The Prior Art

Board-to-board connector assemblies are widely known by those skilled in the art of connector technology and popularly used in laptop computers (portable computers), wherein a board-to-board connector assembly includes a plug and receptacle connector used to be mounted on two separate PCBs, respectively. The two PCBs are electrically interconnected when the plug connector is inserted into the receptacle connector.

U.S. Pat. Nos. 5,057,027 and 5,112,235, Taiwan Patent Nos. 80105936, 81216612 and 83209060, and Japan Patent Nos. 3-173337, 3-359550 and 4-212046 show some board-to-board connector assemblies. These prior art connector assemblies have the common disadvantages as set fort below.

First, none of the contacts in the plug and receptacle connectors have means which can effectively prevent a disengagement between the engaging contacts of two connected connectors when a vibration or shock is exerted thereto.

Second, the gap between the opposite contacts in the receptacle connector is not always kept constant, which may cause the contact force (and therefore the electric resistance) between each pair of the engaging contacts to be different from each other, when the plug connector is inserted into the receptacle connector. Different electric resistance between different engaging contacts means that the transmission of signals between two connected connectors cannot have a good quality. Furthermore, the contacts in the prior art receptacle connectors do not have a preload acting thereon; this way, the contact force between the engaging contacts may not be always large enough to ensure a positive engagement therebetween.

Third, to ensure that the terminal portions of the contacts respectively in the plug and receptacle connectors are spaced from each other a predetermined distance, whereby the terminal portions can be correctly soldered to the PCBS, the prior art connector assemblies need to use spacers in the plug and receptacle connectors to locate the terminal portions of the contacts. Since the spacers are formed individually and then assembled with the housings of the connectors, the spacers additionally increase the cost of the prior art connector assemblies.

Fourth, due to the close fit between an elongated projection in the plug connector and a recess in the receptacle connector for receiving the projection, the projection must be carefully and precisely aligned with the recess to be inserted into the recess so that the two connectors can be connected. Such a precise alignment between the projection and the recess causes the connection of the two connectors to be uneasy and inconvenient. Thus, the connection of the receptacle and plug connectors of the prior art connector assemblies cannot be achieved quickly and efficiently.

Therefore, an objective of the invention is to provide a board-to-board connector assembly including a plug and receptacle connector, wherein a protrusion is formed between the free end and the contact portion of each of the contacts in the plug connector and the contact portion of each of the contacts in the receptacle connector is formed to have an arced configuration. When two connected connectors are going to be separated from each other due to a vibration or shock being exerted thereto, the protrusions will be blocked by the contact portions of the contacts in the receptacle connector to prevent such a separation.

Another objective of the invention is to provide a board-to-board connector assembly including a plug and receptacle connector, wherein the gap of the opposite contacts in the receptacle connector is kept substantially constant, whereby when the plug connector is inserted into the receptacle connector, the contact force between each pair of the engaging contacts is substantially the same. Furthermore, each of the contacts in the receptacle connector is preloaded, whereby when the plug connector is inserted into the receptacle connector, a sufficiently large contact force can be generated between the engaging contacts to ensure a positive engagement therebetween.

A still further objective of the present invention is to provide a board-to-board connector assembly including a receptacle and plug connector, wherein each of the housings of the receptacle and plug connectors is integrally formed with a locating means on a rear side thereof. The locating means is sed to locate the terminal portions of the contacts so that hey can be spaced from each other with a predetermined and usually equal distance.

Yet a still further objective of the present invention is to provide a board-to-board connector assembly including a plug and receptacle connector, wherein the recess of the receptacle connector for receiving the projection in the plug connector has a flared inlet, whereby the projection of the plug connector can be easily inserted into the recess of the receptacle connector to achieve the connection of the two connectors.

SUMMARY OF THE INVENTION

According to an aspect of the invention, a board-to-board connector includes a plug and receptacle connector each having a dielectric housing and a number of contacts extending therethrough. The housing of the receptacle connector includes a front wall defining a recess for receiving an elongated projection in the plug connector, wherein a front end of the front wall defining the recess is chamfered to form a flared inlet for the recess. The flared inlet facilitates an insertion of the elongated projection into the recess. Each of the housings of the connectors is integrally formed with a locating block at a bottom of a rear side of the housing. Each locating block is used to properly space terminal portions of the contacts in the receptacle and plug connectors from each other with a predetermined and equal distance. Each contact in the receptacle connector is so configured that, before engaging with the plug connector, a free end thereof is forced to rest against a first position of the front end of the front wall defining a number of holes, whereby a gap between the opposite contacts in the receptacle connector is kept constant. Furthermore, a preload is exerted to each of the contacts in the receptacle connector when they are at the first position, whereby when the contacts in the receptacle connector are engaged with the and pushed by the contacts in the plug connector to reach a second position, a sufficiently large contact force can be generated between the engaging contacts to ensure a positive engagement therebetween.

DETAILED DESCRIPTION OF THE PREFERRED EMBODIMENTS

References will now be described in detail to the preferred embodiment of the invention. While the present invention has been described in reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
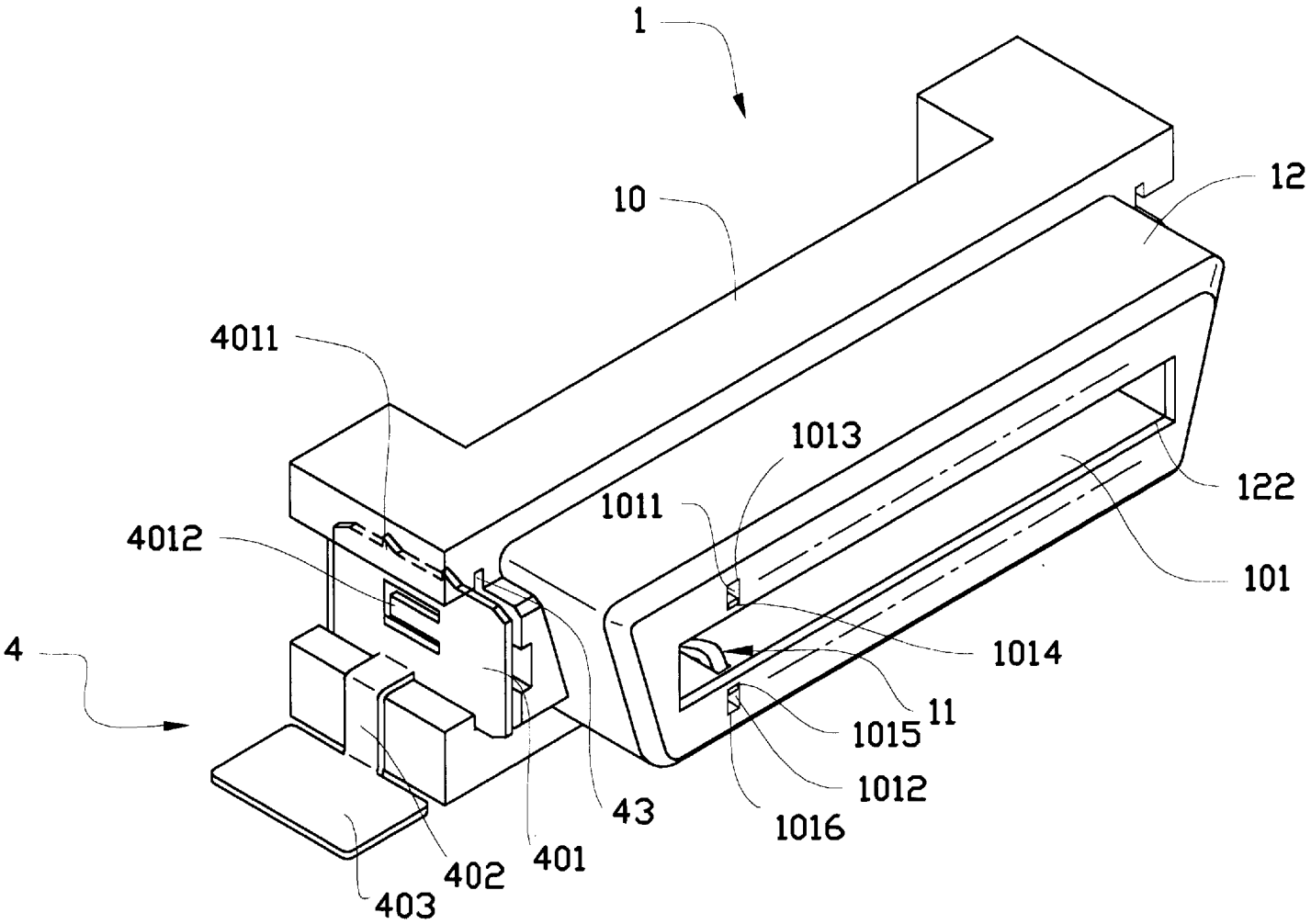
FIG. 1(A) is a perspective view showing a receptacle connector of a board-to-board connector assembly in accordance with the present invention.
FIG. 1(B) is a perspective view showing a plug connector of the board-to-board connector assembly in accordance with the present invention.
Figure 1:
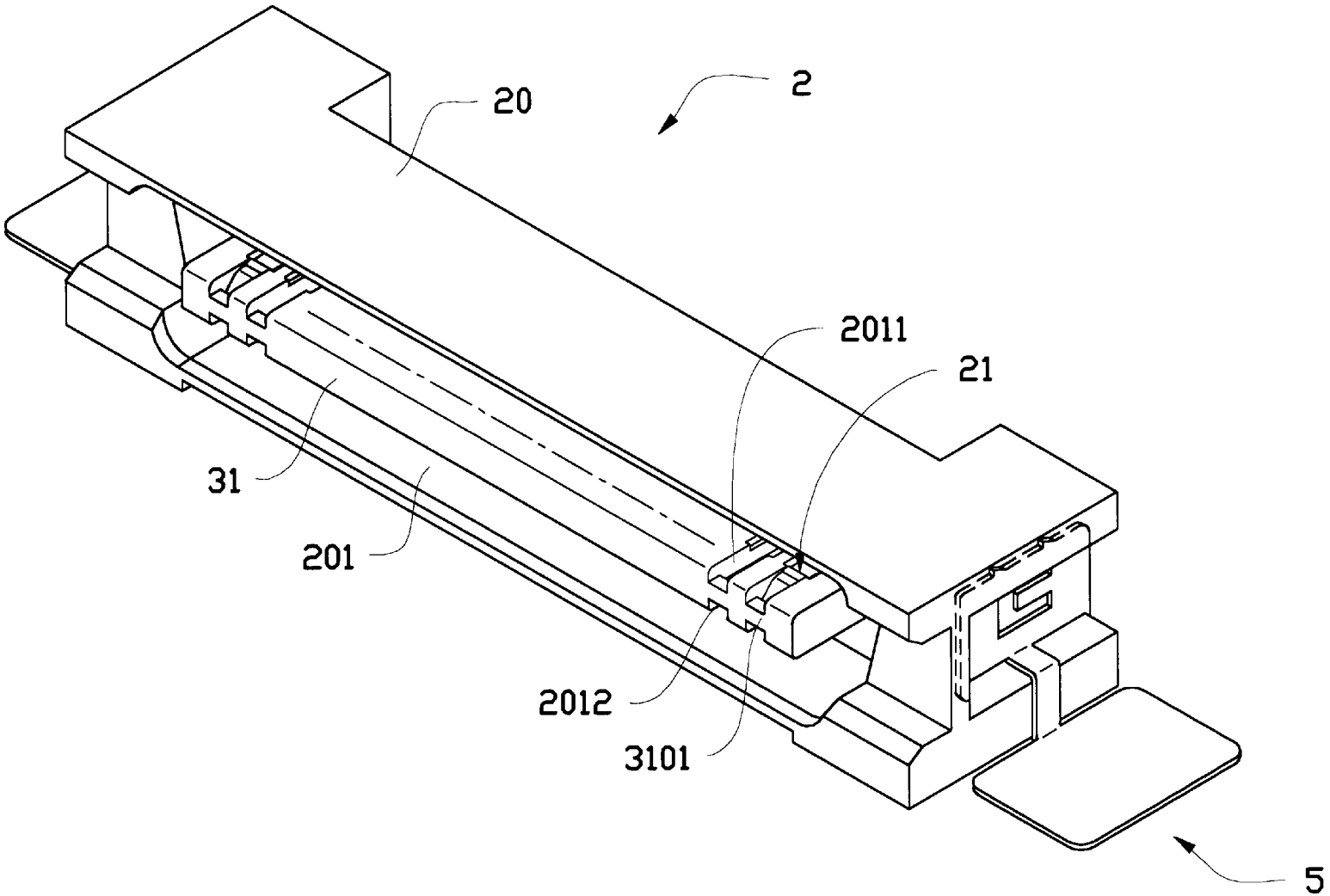
Figure 2:
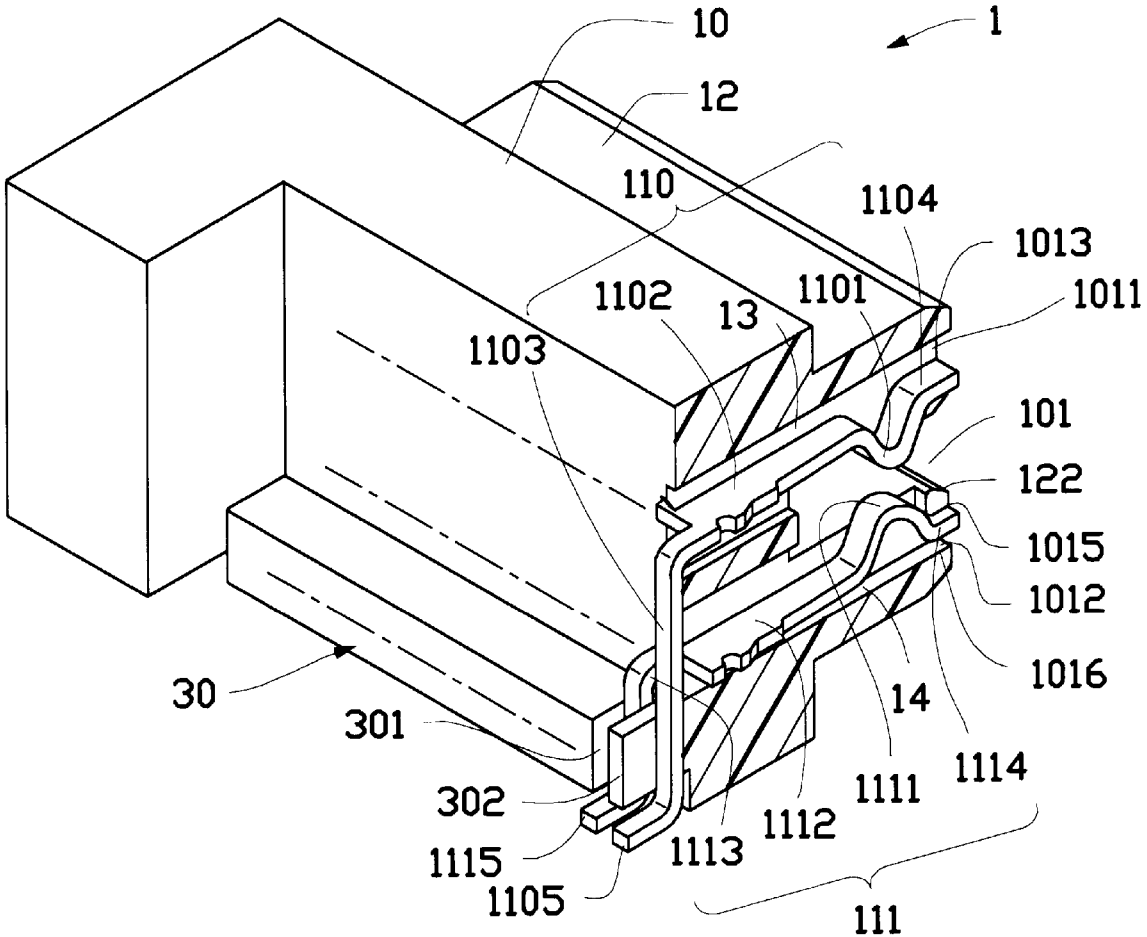
FIG. 2(A) is a partially cut-away, perspective view showing the details of the receptacle connector of FIG. 1(A)
FIG. 2(B) is a partially cut-away, perspective view showing the details of the plug connector of FIG. 1(B)
Figure 2:
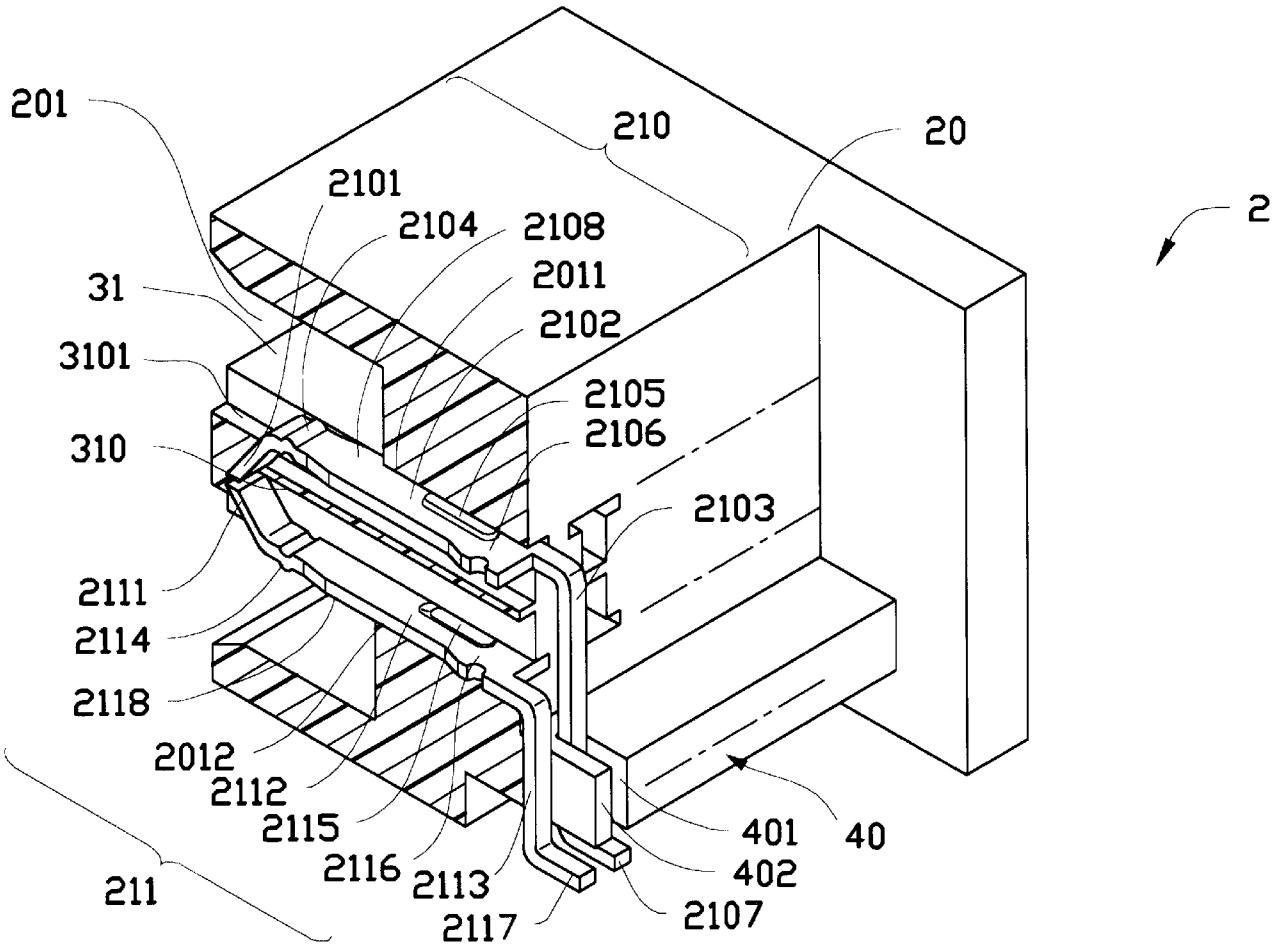

Referring to FIGS. 1(A) and 2(A), a receptacle connector 1 generally includes a dielectric housing 10 having a front wall 12 defining a recess 101 for receiving an elongated projection 31 in a plug connector 2 (FIG. 1(B)). A number of contacts 11 (only one being shown) are fixedly extended through the housing 10. The contacts 11 are divided into upper contacts 110 and lower contacts 111. Each upper contact 110 has a free end 1104 resting against a lower side 1014 of a front end the front wall 12 defining a number of upper holes 1011. Each lower contact 111 has a free end 1114 resting against an upper side 1015 of the front end of the front wall 12 defining a number of lower holes 1012. A pair of first attaching members 4 (only one being shown) is used to attach the housing 10 to a PCB (not shown). Each attaching member 4 consists of an engaging plate 401 defining a toothed side 4011 which is forcedly inserted into a slit 43 defined by the housing 10 about a lateral side thereof, whereby the attaching member 4 is fixed to the housing 10. When the engaging plate 401 is inserted into the slit 43, a resilient leaf 4012 formed about a central portion of the engaging plate 401 is biased to exert a pushing force on the lateral side of the housing 10, thereby to more securely mount the attaching member 4 on the housing 10. The attaching member 4 includes a foot 403 which is connected to the engaging plate 401 via a leg 402. By soldering the foot 403 to the PCB (not shown), the housing 10 can be securely attached to the PCB (not shown).

An inner edge 122 of the front end of the front wall 12 defining the recess 101 is chamfered thereby to make an inlet of the recess 101 have a flared configuration. Thus, the insertion of the elongated projection 31 (FIG. 2(B)) into the recess 101 can be more easily achieved by the present invention than by the prior art connector assemblies.

A locating block 30 is integrally formed along a bottom of a rear side of the housing 10, wherein the locating block 30 consists of a number of locating grooves 301 spaced from each other with an equal distance by a number of partitions 302.

Figure 4:
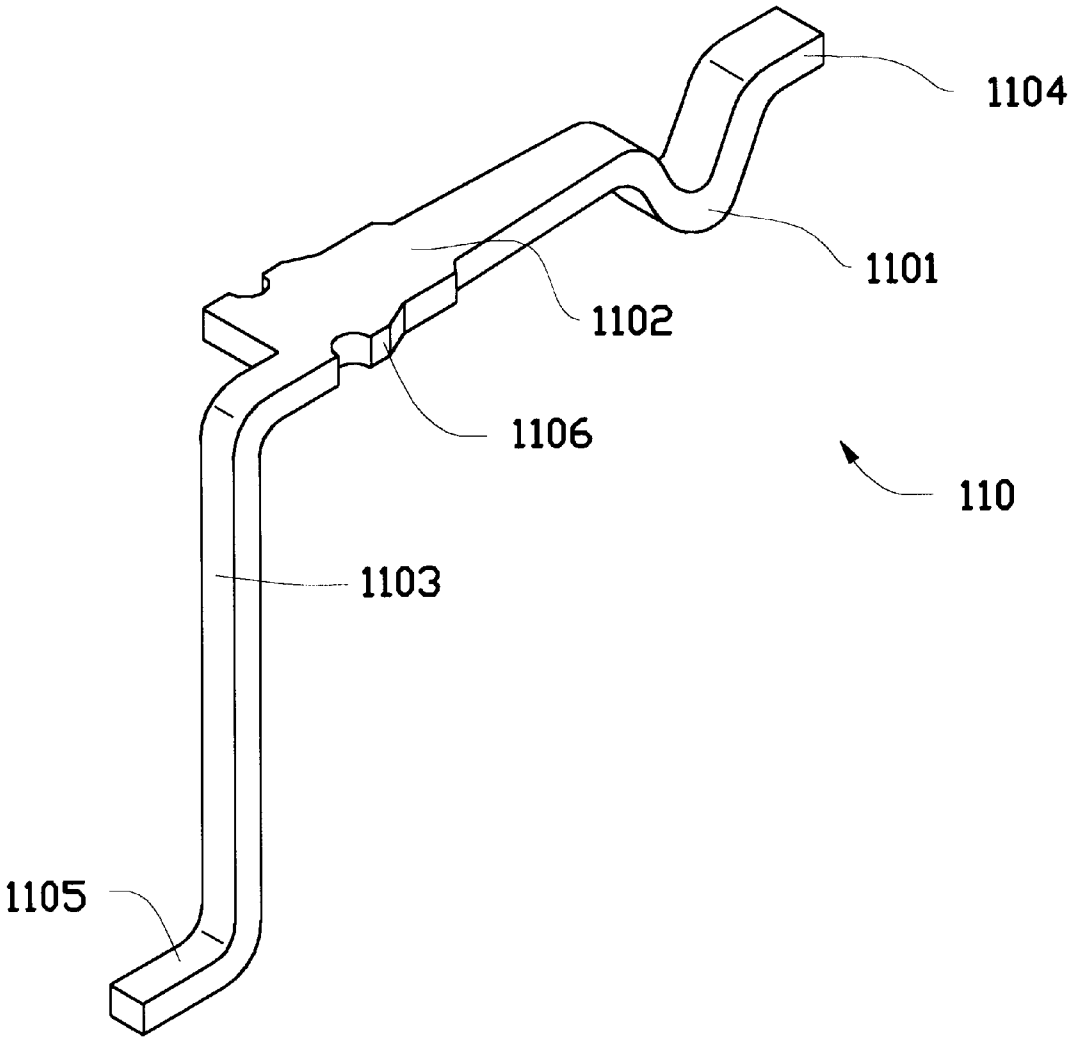
FIG. 4(A) is a perspective view showing an upper contact in the receptacle connector.
FIG. 4(B) is a perspective view showing a lower contact in the receptacle connector.
Figure 4:
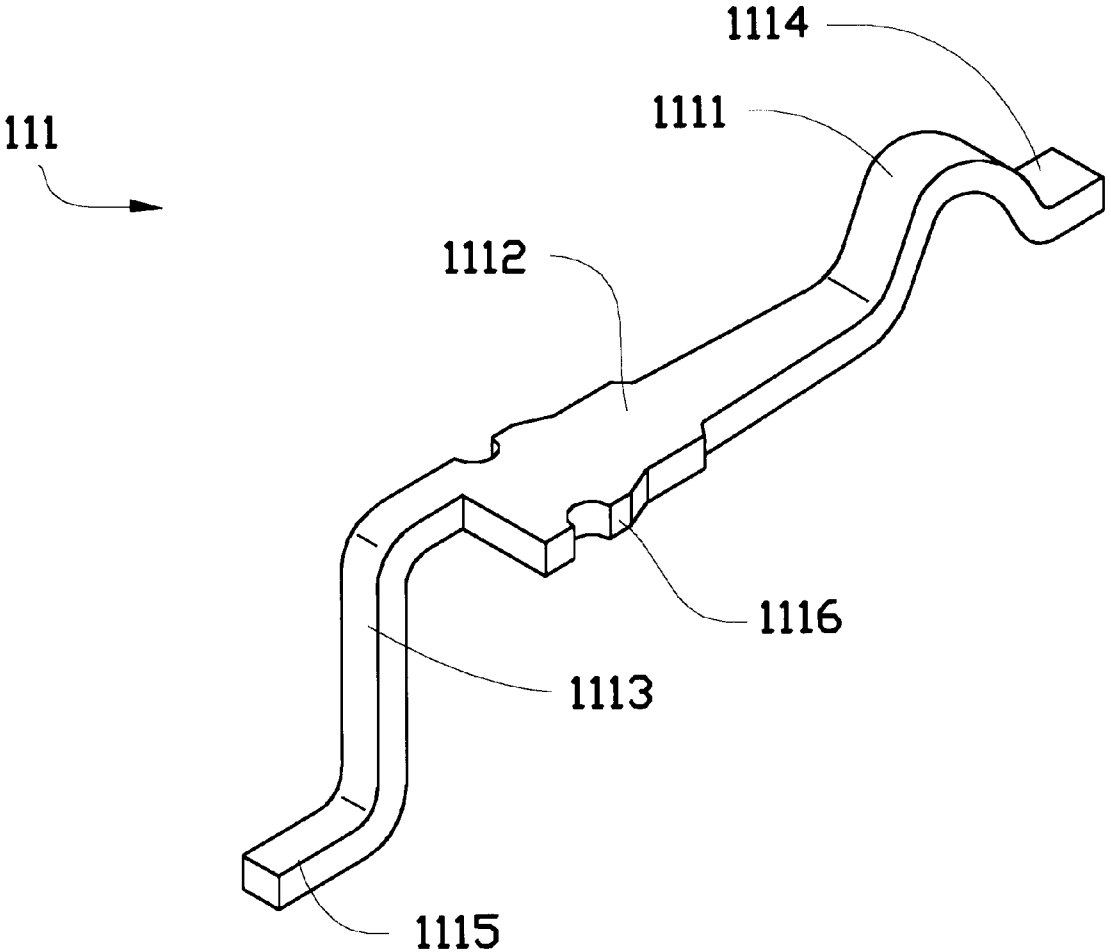

Also referring to FIGS. 4(A) and 4(B), each upper contact 110, in addition to the free end 1104, includes a body portion 1102, a fitting portion 1106 protruding from two lateral sides of the body portion 1102, a contact portion 1101, a leg portion 1103 substantially orthogonal to the body portion 1102, and a terminal portion 1105 substantially orthogonal to the leg portion 1103. Each lower contact 111, in addition to the free end 1114, also includes a body portion 1112, a fitting portion 1116 protruding from two lateral sides of the body portion 1112, a contact portion 1111, a leg portion 1113, and a terminal portion 1115. However, the leg portions 1113 have a length which is much shorter than that of the leg portions 1103. Each contact portion 1101 (1111) is formed to have an arced shape extending toward the recess 101 and located between a corresponding body portion 1102 (1112) and a corresponding free end 1104 (1114), when the contacts 11 are mounted in the housing 10. Each leg portion 1103 (1113) is extended downwards from the body portion 1102 (1112). The contacts 11 are mounted in the housing 10 in this manner that the free ends 1104 (1114) are forced to rest against the front wall 12 defining the holes 1011 (1012) by a preload acting on the free ends 1104 (1114). The preload causes each of the contact portions 1101 (1111) to have a tendency to move toward the recess 101. Each terminal portion 1105 (1115) is extended rearwards from a corresponding leg portion 1103 (1113).

To mount the contacts 11 in the receptacle connector 1, the body portion 1102 of each of the upper contacts 110 is brought to extend through a corresponding upper contact passage 13 and the leg portion 1103 thereof is brought to be inserted into a corresponding locating groove 301 to reach a position, in which the fitting portion 1106 has an interference fit with the housing 10 to fixedly mount the upper contacts 110 in the housing 10. When the upper contacts 110 are mounted in the housing 10, the terminal portions 1105 are at a level substantially the same as that of a bottom of the housing 10.

Thereafter, the body portion 1112 of each of the lower contacts 111 is brought to extend through a corresponding lower contact passage 14 and the leg portion thereof 1113 is brought to be inserted into a corresponding locating groove 301 to reach a position, in which the fitting portion 1116 has an interference fit with the housing 10 to fixedly mount the lower contacts 111 in the upper contact passages 14 and the terminal portions 1115 are at a level substantially the same as that of the bottom of the housing 10.

The terminal portions 1105 and 1115 are spaced from each other a predetermined and equal distance by the partitions 302, whereby the terminal portions 1105 and 1115 can be precisely and correctly soldered to the PCB (not shown). When each contact 11 is mounted in the housing 10 about a corresponding contact passage 13 (14), as mentioned above, the free end 1104 (1114) thereof is forced to rest against the side 1014 (1015) of the front end of the front wall 12 defining the holes loll (1012) so that a preload is exerted to the contact portion 1101 (1111) to cause it to have a tendency to move toward the recess 101.

As mentioned above, since in the present invention, the free ends 1104 and 1114 of the upper and lower contacts 110 and 111 are at a position resting against the sides 1014, 1015 of the front end of the front wall 12 defining the holes 1011, 1012 respectively, the gap between the opposite upper and lower contacts 110, 111 can be kept substantially constant. Therefore, the contact force between each pair of the engaging contacts 11 and 21 (FIG. 1(B), only one being shown) when the projection 31 (FIG. 1(B)) is inserted into the recess 101 is substantially the same.

Referring to FIGS. 1(B) and 2(B), the plug connector 2 also has a pair of attaching members 5 (only one being shown) for attaching the plug connector 2 to a PCB (not shown). Since the attaching members 5 of the plug connector 2 have a structure and function the same as those of the attaching members 4 for the receptacle connector 1, a detailed description of the attaching members 5 is omitted here.

The plug connector 2 has a dielectric housing 20 defining a slot 201 and the elongated projection 31 in the slot 201. A number of upper and lower contact passages 2011, 2012 are formed on an upper and lower side of the projection 31, respectively, and divided by a central wall 310. The central wall 310 is extended from a rear side of the housing 20 to connect with a rib 3101 formed about a front end of the projection 31.

A locating block 40 is integrally formed along a bottom of the rear side of the housing 20. The locating block 40 of the plug connector 2 has a structure and function the same as those of the locating block 30 of receptacle connector 1. The locating block 40 also consists of a number of locating grooves 401 spaced from each other with an equal distance by a number of partitions 402.

Figure 5:
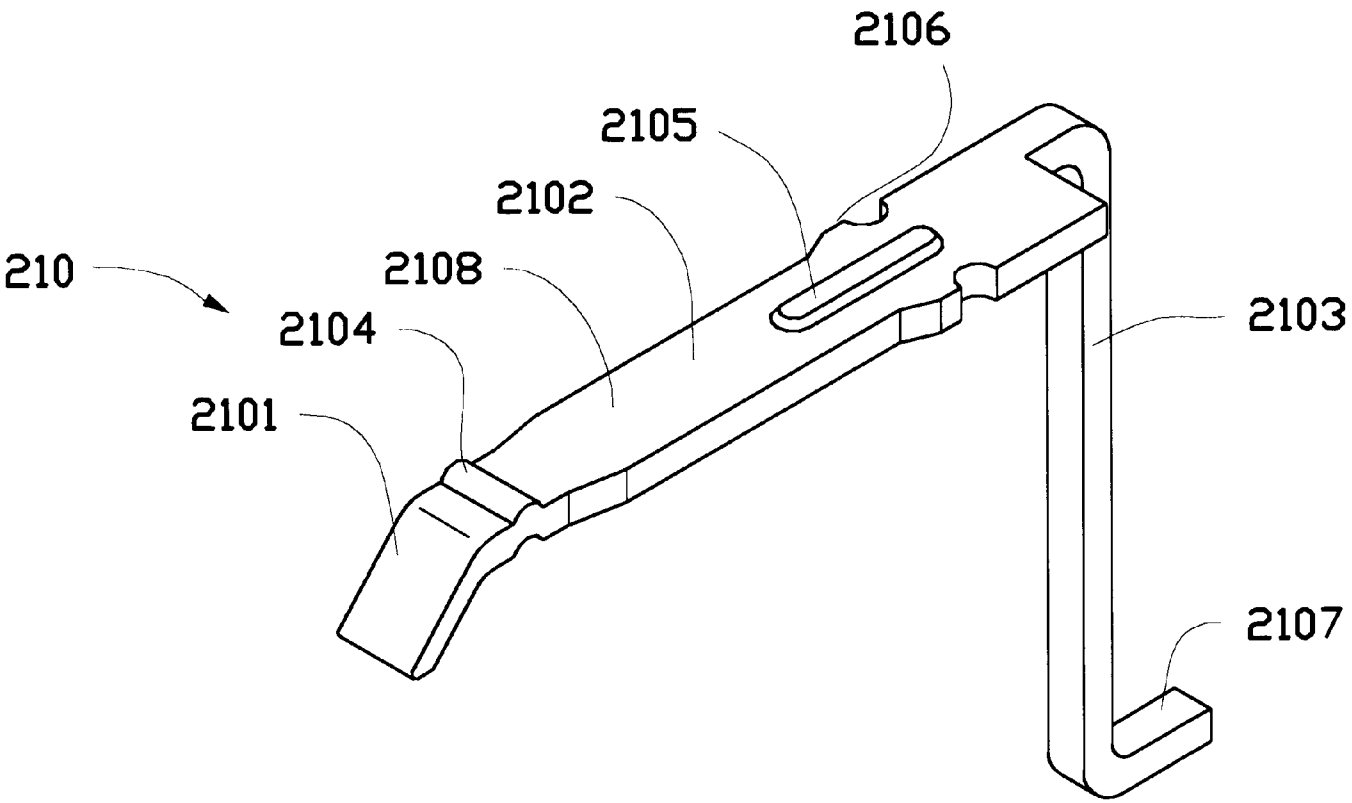
FIG. 5(A) is a perspective view showing an upper contact in the plug connector.
FIG. 5(B) is a perspective view showing a lower contact in the plug connector.
Figure 5:
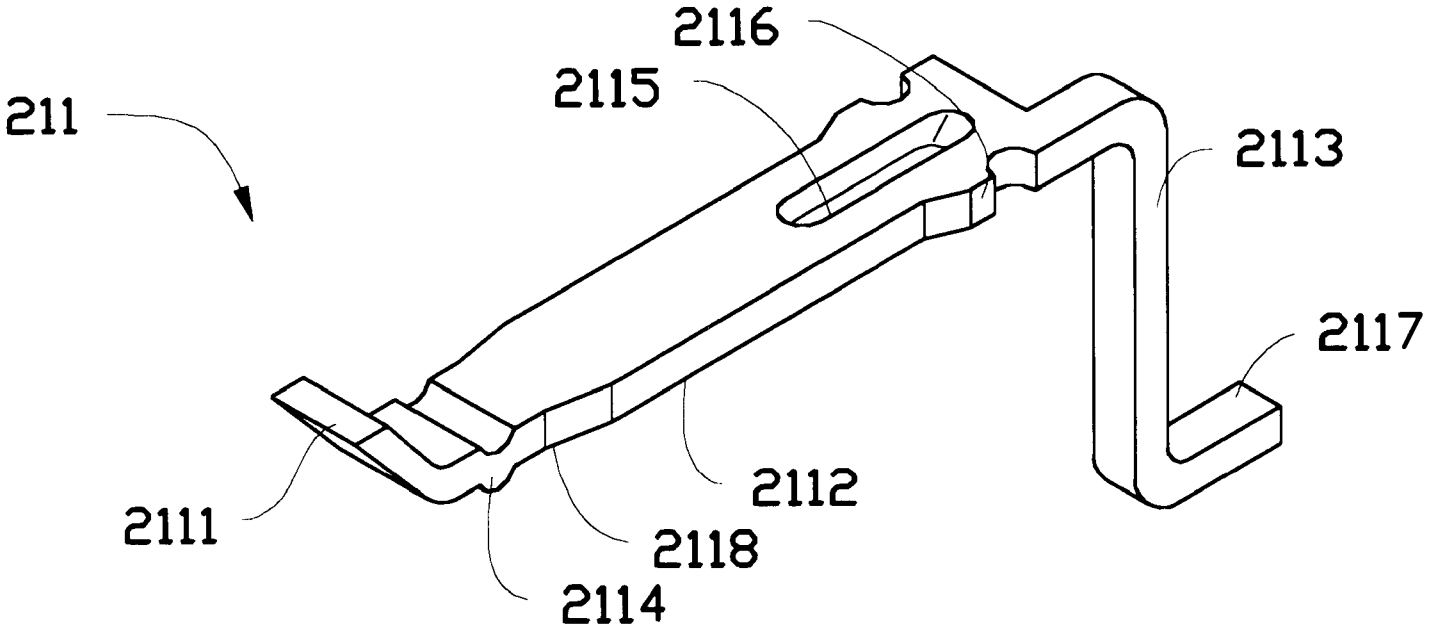

Also referring to FIGS. 5(A) and 5(B), the contacts 21 in the plug connector 2 include upper contacts 210 and lower contacts 211. Each upper contact 210 consists of a body portion 2102, a contact portion 2108 at a front of the body portion 2102, a fitting portion 2106 protruding from two lateral sides of the body portion 2102, a leg portion 2103 substantially orthogonal to the body portion 2102, a bulge 2105 formed on an upper face of the upper contact 210, lengthwise extending along the body portion 2102 and located between the fitting portion 2106, a terminal portion 2107 substantially orthogonal to the leg portion 2103, a free end 2101 and a protrusion 2104 laterally extending on the upper face of the upper contact 210 and located between the contact portion 2108 and the free end 2101.

Each lower contact 211 in the plug connector 2 also consists of a body portion 2112, a contact portion 2118 at a front of the body portion 2112, a fitting portion 2116 protruding from two lateral sides of the body portion 2112, a leg portion 2113, a bulge 2115 formed on a lower face of the lower contact 211, lengthwise extending along the body portion 2112 and located between the fitting portion 2116, a terminal portion 2117, a free end 2111 and a protrusion 2114 laterally extending on the lower face of the lower contact 211 and located between the free end 2111 and the contact portion 2118. However, the leg portions 2113 have a length which is much shorter than that of the leg portions 2103.

To mount the contacts 21 in the housing 20 of the receptacle connector 2, the body portions 2102, 2112 of the upper and lower contacts 210, 211 are brought to extend through the upper and lower contact passages 2011, 2012 to reach a position wherein the fitting portions 2106, 2116 and the bulges 2105, 2115 have an interference fit with the housing 20 to fixedly mount the contacts 21 in the housing 20; the free ends 2101, 2111 rest against corners defined between the central wall 310 and the rib 3101; the contact portions 2108, 2118 and the protrusions 2104, 2114 are exposed to the slot 201; the leg portions 2013, 2113 are guided into the locating grooves 401; and the terminal portions 2017, 2117 are located at a level substantially the same as that of a bottom of the hosing 20 and spaced from each other with a predetermined and equal distance by the partitions 402, whereby the terminal portions 2107 and 2117 can be precisely and correctly soldered to the PCB (not shown) without the necessity to additionally attach a spacer to the housing 20 to locate the position of the terminal portions 2107, 2117.

The bulges 2015, 2115 are used to not only have an interference fit with the housing 20 to fix the contacts 210 and 211 in the housing 20, but also increase the rigidity of the body portions 2102, 2112 to prevent a bending of the body portions 2102, 2112 relative to the leg portions 2103, 2113, when the contacts 210, 211 are engaged with the contacts 110, 111.

Figure 3:
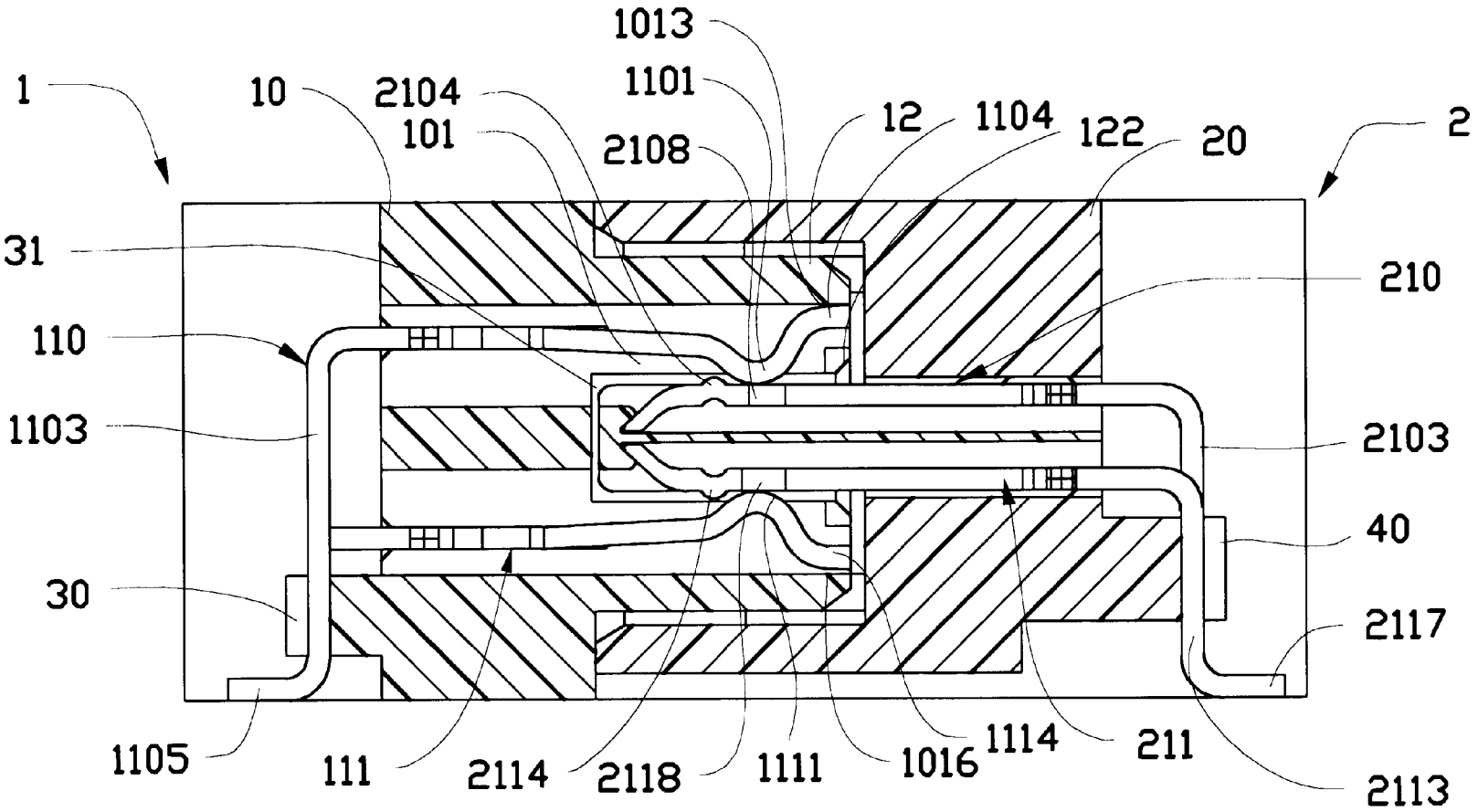
FIG. 3 is a cross-sectional view showing that the receptacle and plug connectors are connected.

Referring to FIG. 3, to connect the two connectors 1 and 2, the projection 31 is brought to be inserted into the recess 101 and the housing 20 of the plug connector 2 defining the slot 201 is brought to be extended over the front wall 12 of the housing 10 of the receptacle connector 1. When the two connectors 1, 2 are connected, the contact portions 1101, 1111 of the upper and lower contacts 101 and 111 of the receptacle connector 1 are pushed away from their original position to reach a second position wherein the free ends 1104, 1114 thereof abut an upper and lower side 1013, 1016 of the front end of the front wall 12 defining the upper and lower holes 1011, 1012 (FIG. 1(A)).

As mentioned above, before the receptacle connector 1 is connected with the plug connector 2, the free ends 1104, 1114 of the contacts 11 are forced to rest against the lower and upper sides 1014, 1015 of the front end of the front wall 12 defining the upper and lower holes 1011, 1012 (FIG. 1(A)) by a preload acting on the free ends 1104, 1114. Thus, when the contact portions 1101, 1111 are pushed by the contact portions 2108, 2118 of the contacts 21 in the plug connector 2 to have an engagement therewith, the contact force between the engaging contacts 11, 21 is a sum of the pushing force plus the preload. This way, the contact force is large enough to ensure a positive engagement between the contacts 11 and 21. Furthermore, when the two connectors 1, 2 are connected, the protrusions 2104, 2114 on the contacts 21 are moved to a position behind the contact portions 1101 and 1111 of the contacts 11, whereby the connectors 1, 2 will not be easily separated from each other even if a large vibration or shock is exerted thereto, since to separate the two connected connectors 1, 2, the protrusions 2104, 2114 will firstly be blocked by the arc-shaped contact portions 1101, 1111 of the contacts 11.

Finally, as mentioned above, since in the present invention the inlet of the recess 101 in the receptacle connector 1 is constructed to have a flared configuration, the projection 31 in the plug connector 2 can be easily inserted into the recess 101 of the receptacle connector 1 to accomplish the connection of the two connectors 1, 2, even if the projection 31 is not precisely aligned with the recess 101.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field shall understand that all such equivalent structures are to be included within the scope of the following claims.

I claim:

1. A board-to-board connector assembly for connecting two printed circuit boards (PCBs), comprising:

a plug connector, comprising:

a first dielectric housing; and a number of first contacts extending through the first housing and consisting of first upper contacts and first lower contacts, each first upper contact having a first contact portion, a first leg portion perpendicularly continuing from the first contact portion and a first terminal portion perpendicularly continuing from the first leg portion, said first terminal portion being used for connecting with a corresponding first PCB, each first lower contact having a second contact portion, a second leg portion perpendicularly continuing from the second contact portion and a second terminal portion perpendicularly continuing from the second leg portion for connecting with the first PCB, a line connecting the connecting points between the second leg portions and the second contact portions vertically intersecting with each first leg portion;

a receptacle connector connected with the plug connector, comprising:

a second electric housing; and a number of second contacts extending through the second housing and consisting of second upper contacts and second lower contacts, each second upper contact having a third contact portion engaging with the first contact portion of the corresponding first upper contact, a third leg portion perpendicularly continuing from the third contact portion and a third terminal portion perpendicularly continuing from the third leg portion, said third terminal portion being used for connecting with a corresponding second PCB, each second lower contact having a fourth contact portion engaging with the second contact portion of the corresponding first lower contact, a fourth leg portion perpendicularly continuing from the fourth contact portion and a fourth terminal portion perpendicularly continuing from the fourth leg portion for connecting with the second PCB, a line connecting the connecting points between the fourth contact portions and the fourth leg portions vertically intersecting with each third leg portion;

wherein the first contacts each have a protrusion formed thereon, and the third and fourth contact portions of the second contacts each have an arc-like configuration engaging with a corresponding first contact, the protrusions being blocked by the third and fourth contact portions when the plug connector is removed to separate from the receptacle connector, and wherein each of the housings defines a front side for connecting with each other and a rear side opposite the front side, each of the housings being integrally formed with a locating block on its rear side, each of the locating blocks defining a number of grooves through which the first, second, third and fourth leg portions of the first and second contacts fittingly extend whereby the first and second terminal portions are spaced from each other a predetermined distance, and the third and fourth terminal portions are spaced from each other a predetermined distance.

2. The board-to-board connector assembly in accordance with claim 1, wherein each of the locating blocks is formed along a lower part of each of the rear sides of the first and second housings.

3. The board-to-board connector assembly in accordance with claim 1, wherein the third and fourth contact portions of the second contacts are engaged with the first contacts by a contact force which is a sum of a preload already exerted to the second contacts and a pushing force of the first contacts acting on the third and fourth contact portions of the second contacts.

4. The board-to-board connector assembly in accordance with claim 3, wherein each of the second contacts comprises a free end which is forced to rest against the second housing by the preload when the receptacle connector is separated from the plug connector.

5. The board-to-board connector assembly in accordance with claim 1, wherein the first housing defines a slot and a projection in the slot for receiving the first contacts, and the second housing has a front wall defining a recess for receiving the second contacts, the recess being formed with a flared inlet so that projection can be easily inserted into the recess to achieve the connection of the receptacle connector with the plug connector.

6. The board-to-board connector assembly in accordance with claim 5, wherein each of the first contacts further has a first free end engaging with a front end of the projection, a first body portion between the first contact portion and the first leg portion and between the second contact portion and the second leg portion and defining a first fitting portion projecting from a lateral side of the first body portion and a first bulge lengthwise extending along the first body portion, said first fitting portion and first bulge having an interference fit with the first housing.

7. The board-to-board connector assembly in accordance with claim 6, wherein the protrusion is located between the free end and the first contact portion, and between the free end and the second contact portion.

8. The board-to-board connector assembly in accordance with claim 1, wherein each of the second contacts further comprises a second free end in front of the third contact portion and fourth contact portion, and a second body portion between the third contact portion and the third leg portion and between the fourth contact portion and the fourth leg portion, each second body portion defining a second fitting portion projecting from a lateral side thereof, the second fitting portion having an interference fit with the second housing.

9. The board-to-board connector assembly in accordance with claim 1, wherein each of the plug and receptacle connectors further comprises an attaching member mounted at a lateral side of each of the first and second housings for attaching the first and second housings to the printed circuit boards.

10. The board-to-board connector assembly in accordance with claim 9, wherein the attaching member has an engaging plate fixedly engaging with the lateral side and a foot for connecting with a corresponding printed circuit plate, the engaging plate defining a toothed side having an interference fit with the lateral side and a resilient leaf exerting a pushing force on the lateral side.

11. A board-to-board connector assembly, comprising:

a receptacle connector, comprising:

a first dielectric housing having a front wall defining a recess, a first position and a second position wherein the first position is located nearer to the recess than the second position;

a number of first contacts extending through the first dielectric housing, each first contact having a first free end resting against the front wall about the first position by a preload acting on the first contacts to force the free ends of the first contacts to have a tendency moving toward the recess, the first contacts consisting of upper first contacts and lower first contacts, each upper first contact having a first contact portion extending rearwardly from the first free end, a first leg portion perpendicularly extending from the first contact portion and a first terminal portion perpendicularly extending from the first leg portion, each lower first contact having a second contact portion extending from the first free end, a second leg portion perpendicularly extending from the second contact portion and a second terminal portion perpendicularly extending from the second leg portion, a line connecting the connecting points between the second contact portions and the second leg portions perpendicularly intersecting with the first leg portions of the upper first contacts; and a plug connector, comprising:

a second dielectric housing defining a projection;

a number of second contacts extending through the second dielectric housing, each second contact consisting of upper second contacts and lower second contacts, each upper second contact including a third contact portion, a third leg portion perpendicularly extending from the third contact portion and a third terminal portion perpendicularly extending from the third leg portion, each lower second contact including a fourth contact portion, a fourth leg portion perpendicularly extending from the fourth contact portion and a fourth terminal portion perpendicularly extending from the fourth leg portion, a line connecting the connecting points between the fourth contact portions and the fourth leg portions vertically intersecting with the third leg portions of the upper second contacts;

wherein when the plug connector is connected with the receptacle connector by inserting the projection into the recess to cause the first contact portions to engage with the third contact portions and the second contact portions to engage with the fourth contact portions, the first contacts are pushed to leave the first position to reach the second position by a pushing force of the second contacts acting on the first contacts, whereby a contact force between the engaging first and second contacts is a sum of the pushing force and the preload;

and wherein each of the housings is integrally formed with a locating block defining a number of grooves through which the first, second, third and fourth leg portions of the first and second contacts fittingly extend whereby the first and second terminal portions are spaced from each other a predetermined distance, and the third and fourth terminal portions are spaced from each other a predetermined distance.

12. The board-to-board connector assembly in accordance with claim 11, wherein the front wall of the first housing defines a number of upper holes and lower holes beside the recess, each hole having an upper and lower side, wherein the upper side of the lower holes and the lower side of the upper holes define the first position, and the lower side of the lower holes and the upper side of the upper holes define the second position.

13. The board-to-board connector assembly in accordance with claim 11, wherein the second contacts further comprise a means for preventing a separation of the engagement between the first and second contacts.

14. The board-to-board connector assembly in accordance with claim 13, wherein the means is a protrusion formed on each of the second contacts, the protrusions being blocked by the first and second contact portions of the first contacts which are in engagement with the third and fourth contact portions of the second contacts.

15. The board-to-board connector assembly in accordance with claim 14, wherein each of the first and second contact portions of each of the first contacts is formed to have an arced configuration.

16. A receptacle connector for a board-to-board connector assembly, comprising:

a dielectric housing having a front side for connecting with a mating plug connector and a rear side opposite to the front side and integrally formed with a locating block defining a number of grooves at a rear side thereof, the grooves being equidistantly spaced from each other, and a number of contacts extending through the dielectric housing and consisting of upper contacts and lower contacts, each upper contact having a horizontal termination portion for being soldered to a printed circuit board, a vertical leg portion upwardly extending from the termination portion through a corresponding one of the grooves defined by the locating block, and a horizontal contact portion perpendicularly extending from the leg portion for engaging with a corresponding contact in the mating plug connector, each lower contact having a horizontal termination portion for being soldered to the printed circuit board, a vertical leg portion upwardly extending from the termination portion through a corresponding one of the grooves defined by the locating block in a manner that the leg portions of the lower contacts are alternative with the leg portions of the upper contacts and equally spaced therefrom, and a horizontal contact portion perpendicularly extending from the leg portion for engaging with a corresponding contact in the mating plug connector, a line connecting the connecting points between the leg portions and the contact portions of the lower contacts vertically intersecting with the leg portions of the upper contacts.

17. The receptacle connector in accordance with claim 16, wherein the housing defines a recess for insertion of a projection in a mating plug connector and each of the contacts has a free end resting against the housing by a preload thereby urging the contact portions toward the recess.

18. The receptacle connector in accordance with claim 17, wherein the recess has an flared inlet.

19. A plug connector for a board-to-board connector assembly, comprising:

a dielectric housing having a front side for connecting with a mating receptacle connector and a rear side opposite the front side and integrally formed with a locating block defining a number of grooves at a rear side thereof, the grooves being equidistantly spaced from each other; and a number of contacts extending through the dielectric housing, the contacts consisting of upper contacts and lower contacts, each upper contact having a horizontal termination portion for being soldered to a printed circuit board, a vertical leg portion upwardly extending from a corresponding one of the terminal portions through a corresponding one of the grooves defined by the locating block, and a horizontal contact portion perpendicularly extending from the leg portion for engaging with a corresponding contact in the mating receptacle connector, each lower contact having a horizontal terminal portion for being soldered to the printed circuit board, a vertical leg portion upwardly extending from a corresponding one of the terminal portions through a corresponding one of the grooves in a manner that the leg portions of the lower contacts are alternative with the leg portions of the upper contacts and spaced therefrom an equal distance, and a horizontal contact portion perpendicularly extending from the leg portion for engaging a corresponding contact in the mating receptacle connector, a line connecting the connecting points between the contact portions and leg portions of the lower contacts vertically intersecting with the leg portions of the upper contacts.

20. The plug connector in accordance with claim 19, wherein each of the contacts has a free end resting against the housing and a protrusion between the free end and the contact portion.

* * * * *